United States Patent [19]

Crist

[11] 4,081,627

[45] Mar. 28, 1978

[54] ELECTROMAGNETIC BIPOLAR LOUD SPEAKER

[75] Inventor: Scott D. Crist, Hopkins, Minn.

[73] Assignee: Audio Research Corporation, Minneapolis, Minn.

[21] Appl. No.: 754,510

[22] Filed: Dec. 27, 1976

[51] Int. Cl.[2] ..... H04R 9/00
[52] U.S. Cl. ..... 179/115.5 PV
[58] Field of Search ..... 179/115.5 PV

[56] References Cited

U.S. PATENT DOCUMENTS

| | | | |
|---|---|---|---|
| 3,919,499 | 11/1975 | Winey | 179/115.5 PV |
| 4,020,296 | 4/1977 | Dahlquist | 179/115.5 PV |

FOREIGN PATENT DOCUMENTS

| | | | |
|---|---|---|---|
| 939,508 | 11/1948 | France | 179/115 V |

*Primary Examiner*—George G. Stellar
*Attorney, Agent, or Firm*—Schroeder, Siegfried, Ryan, Vidas and Steffey

[57] ABSTRACT

An electromagnetic bipolar loud speaker of the planar type utilizing a vibratable diaphragm having conductors positioned thereon and uniformly distributed over the vibratable area of the diaphragm to interact with a unidirectional, homogeneous magnetic field generated by a coil surrounding the diaphragm. The loud speaker may be made of a number of diaphragms with different sized vibratable areas and with the same conductor orientation thereon with respect to the supporting frame and energizing magnetic field to cover the wide range of frequency responses.

10 Claims, 6 Drawing Figures

ELECTROMAGNETIC BIPOLAR LOUD SPEAKER

This invention relates to an electromagnetic bipolar loud speaker or more particularly to a transducer of this type using a planar type of diaphragm of vibratable areas and conductors thereon in a homogeneous magnetic field which surrounds the diaphragm.

Electromagnetic transducers and electrostatic transducers for loud speakers which use a vibrating diaphragm are known and in use. Examples of such transducers will be found in the U.S. Pat. Nos. to Arthur A. Janszen 2,631,196 dated 3/10/53 and entitled ELECTROSTATIC LOUD SPEAKER, and James N. Winey, 3,674,946 dated July 4, 1972 and entitled ELECTROMAGNETIC TRANSDUCER. In such electromagnetic transducer constructions, the problem of fabricating a field element and the alignment of the polar regions of the field element with the conductors on the diaphragm increase the cost of the transducer or loud speaker and restrict the operating range of the transducer within the audio frequency ranges. Similarly, in electrostatic designs, the choice of materials utilized in the transducer, the power requirements for the same and the orientation of the conductors on the diaphragm and with respect to the vibratable areas similarly increase costs and restrict output characteristics and range.

In the present invention, the electromagnetic transducer utilizes a taut diaphragm of dielectric material having conductors positioned therein in uniformly spaced parallel relationship. The conductors are interconnected in such a manner that current flows through the conductors in the same direction relative to the vibratable area of the diaphragm on which they are mounted to give a current sheet effect to the diaphragm. Magnetic field means in the form of a coil is wound around the diaphragm to generate a homogeneous magnetic field whose direction is normal to the current sheet or current flow in the conductors causing vibration of the diaphragm. The conductors are interconnected to provide the desired current flow by connections which extend out of the coil to be disposed outside of the magnetic field so as not to be moved thereby or affect movement of the diaphragm. Energization of the conductors is from an audio frequency signal source. A number of such diaphragms with vibratable areas may be mounted in a planar frame with the conductors similarly oriented so that a single magnetic field generator may be positioned over and around the frame to provide the field which will cause simultaneous displacement of all vibratable areas. This arrangement of parts eliminates the critical alignment of conductors in a magnetic field and permits the use of a single homogeneous magnetic field which is energized from a simplified power supply. It eliminates the use of permanent magnets in the field generating element and the critical mounting and orientation of the same with respect to the conductors upon the diaphragm. The diaphragm is a thin, low mass structure which is stretched taut and has conductors deposited thereon in the form of strips of highly conductive material giving a low mass vibratable element which has excellent transient response. The conductors may be so interconnected to give a high or a low impedance circuit enabling it to be powered with a high current — low voltage or a high voltage — low current audio frequency source. The diaphragms mounted in a planar frame may have different sized vibratable areas which are all influenced by the field generated by the same magnetic field generating element. This will provide a loud speaker design with a wide range of audio frequency output.

It is therefore an object of the invention to provide an improved electromagnetic current sheet transducer or loud speaker.

Another object of the invention is to provide an electromagnetic bipolar loud speaker which requires only a single field energizing coil wound around the vibratable diaphragms of the loud speaker to operate the same and provide an active magnetic field which employs no permanent magnets.

A further object of this invention is to provide an improved electromagnetic sheet transducer which utilizes a low mass vibratable diaphragm with conductors deposited on the same and a homogeneous magnetic field energizing element which eliminates critical alignment of parts.

A still further object of this invention is to provide a loud speaker design utilizing a plurality of current sheet transducers of this type in a homogeneous magnetic field with the transducers having different size vibratable areas to provide a wide range of frequency response.

Another object of this invention is to provide an improved electromagnetic loud speaker in which the conductors on the vibratable diaphragms may be connected in various circuit configurations to provide variable impedance circuits to match the impedance of an audio frequency supply.

It is also an object of this invention to provide an improved electromagnetic loud speaker which is simple in design and economical to manufacture.

These and other objects of the invention will become apparent from the reading of the attached description together with the drawings wherein.

Figure 1:
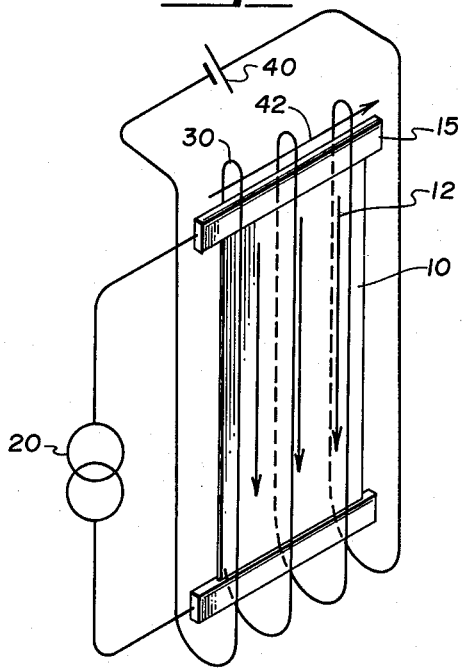
FIG. 1 is a diagrammatic view of an electromagnetic transducer or loud speaker showing the principle of the invention in a current sheet transducer.
Figure 2:
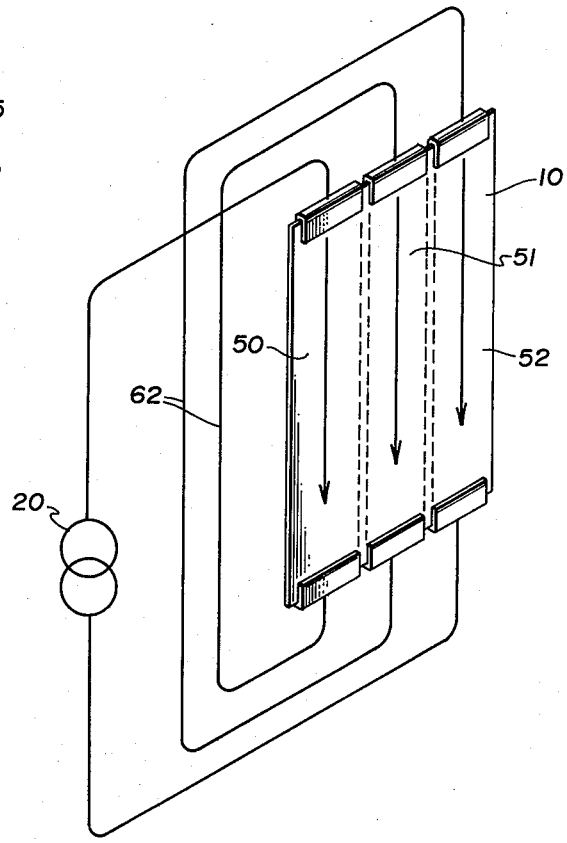
FIG. 2 is a diagrammatic view of the diaphram and conductors of the current sheet transducer.

FIG. 1 discloses diagrammatically an arrangement of parts which best exemplifies the principle of the subject invention. The numeral 10 depicts a vibratable diaphragm of a loud speaker or transducer. The diaphragm 10 has a flexible conductive surface thereon as depicted by the current flow arrows 12 with a suitable frame and bus like conductors 15 at the ends of the same which conductors are connected to an amplifying source 20 which directs an oscillating or audio frequency signal to the conductive sheet on the diaphragm. The plurality of arrows 12 indicate an infinite number of conductors extending between the buses 15 at the extremeties of the vibratable area of the diaphragm to carry current in the same direction. This provides a current sheet on the surface of the diaphragm with current flow in the same direction between the buses. The diaphragm 10 has positioned around the same an energizing field element in the form of a coil 30 which is wound around the diaphragm and with the turns distributed along the extent of the same to encircle the diaphragm. Coil 30 is energized from a unidirectional source which is indicated by the battery 40 to provide a homogeneous electromagnetic field of the homogeneous type in which flux lines emanating from energization of the coil will flow in the direction indicated by the arrow 42 across the diaphragm and through the surface of the same. Such flux lines will be normal to the direction of current flow on the planar diaphragm through the current conductor surface. FIG. 2 depicts the diaphragm 10 as having a plurality of conducting surfaces thereon, such as is indicated at 50, 51, and 52, to indicate the plurality of individual conductors with dielectric spacing therebetween. These conductors are connected in a series type circuit through external lead wiring 62 which connect the end of one conductor to the opposite end of the next adjacent conductor and back to the energizing amplifying source. As distinguished from FIG. 1, the plurality of spaced parallel conductors on the planar type diaphragm, preferably of dielectric material, will provide total impedance to the energizing amplifier which is greater than that of the conductor formed by the sheet shown diagrammatically in FIG. 1. In this manner, the impedance of the circuit which includes the conductors on the diaphragm may be varied or increased to match the impedance output of an energizing amplifier.

Figure 3:
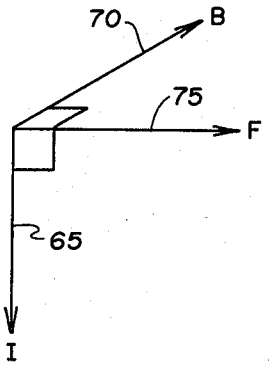
FIG. 3 is a force diagram showing the principle of the invention.

FIG. 3 shows a conventional force diaphragm of the interaction of current flow through the conductors with the magnetic field and the resultant force generated thereby. Thus, in FIG. 3, the current flow, as indicated by the arrow 65, will interact with the field vector shown by the arrow 70 to provide a resultant force vector 75. This conventional force diaphragm indicates the force applied to the vibratable diaphragm in the current sheet transducer to vibrate the same with oscillation of the current through the conductors thereon.

The principles of my electromagnetic bipolar loud speaker current sheet conductor are applied to a transducer which is similar in shape to a full range electrostatic loud speaker or a permanent magnet type loud speaker in which the vibratable diaphragms are mounted in a planar type frame. The diaphragm in my improved device is preferably made of a thin sheet of Mylar or polyethylene-terephthalate material suitably mounted on a frame to have a vibratable area therein. The conductors are preferably of highly conductive material which are deposited on the diaphragm in conductor strips. Thus, a thin layer of gold or other suitable highly conductive material will be deposited on the diaphragm to form the conductive sheet. The conductors are very thin, measured in angstrom units or millionth of an inch, and the resultant assembly is a very low mass diaphragm assembly. As indicated in FIG. 1, current buses distributed along the frame supporting the vibratable diaphragm are connected to the conductive sheet to provide a uniform current distribution down the entire vibratable area or sheet and uniform across its entire width. Current will be supplied from an amplifier which in the case of a loud speaker would have audio frequency outputs. Essentially what is shown in FIG. 1 is a single turn conductor configuration in which motion of the diaphragm results from an interaction of this distributed current within the uniform magnetic field surrounding the diaphragm. Although battery sources are shown, it will be recognized that a simplified unidirectional power source of any type that is, constant voltage or constant current source, may be employed. The magnetic field for this type of loud speaker is active in that it employs no permanent magnets. It will be recognized that the signal and field sources to the diaphragm conductors and the field coil may be interchanged and still cause movement of the diaphragms. However, the field winding self inductance may or may not make this arrangement preferred.

As indicated in FIG. 3, the currents may be divided into a plurality of parts, as for example that shown in the diagram of FIG. 2 as three equal parts. This arrangement of conductors and the current conductors to the same permits a higher impedance transducer. The parts are connected in a series circuit by external conductors that are not permitted to move within the magnetic field. Thus these external conductors are connected to the part and extend outside the main helex or coil which provides the uniform magnetic field in which the total diaphragm is emersed. By adjusting the number of conductors and the connection of the same, a designed impedance for the transducer may be effected permitting the use of the same with either a low voltage-high current, or a low current-high voltage energizing supply. This transducer or type of loud speaker results in a low mass configuration which gives excellent transient response.

As will be hereinafter noted, a number of sections or vibratable diaphragms may be employed in the transducer or loud speaker each covering a different frequency range. The planar frame upon which the diaphragms are suspended or stretched can be a part of the magnetic field assembly or conceivably this frame can be inserted into a separate magnetic field assembly eliminating the need for critical alignment of the magnetic field element with the conductors on the movable elements of the transducer.

Figure 4:
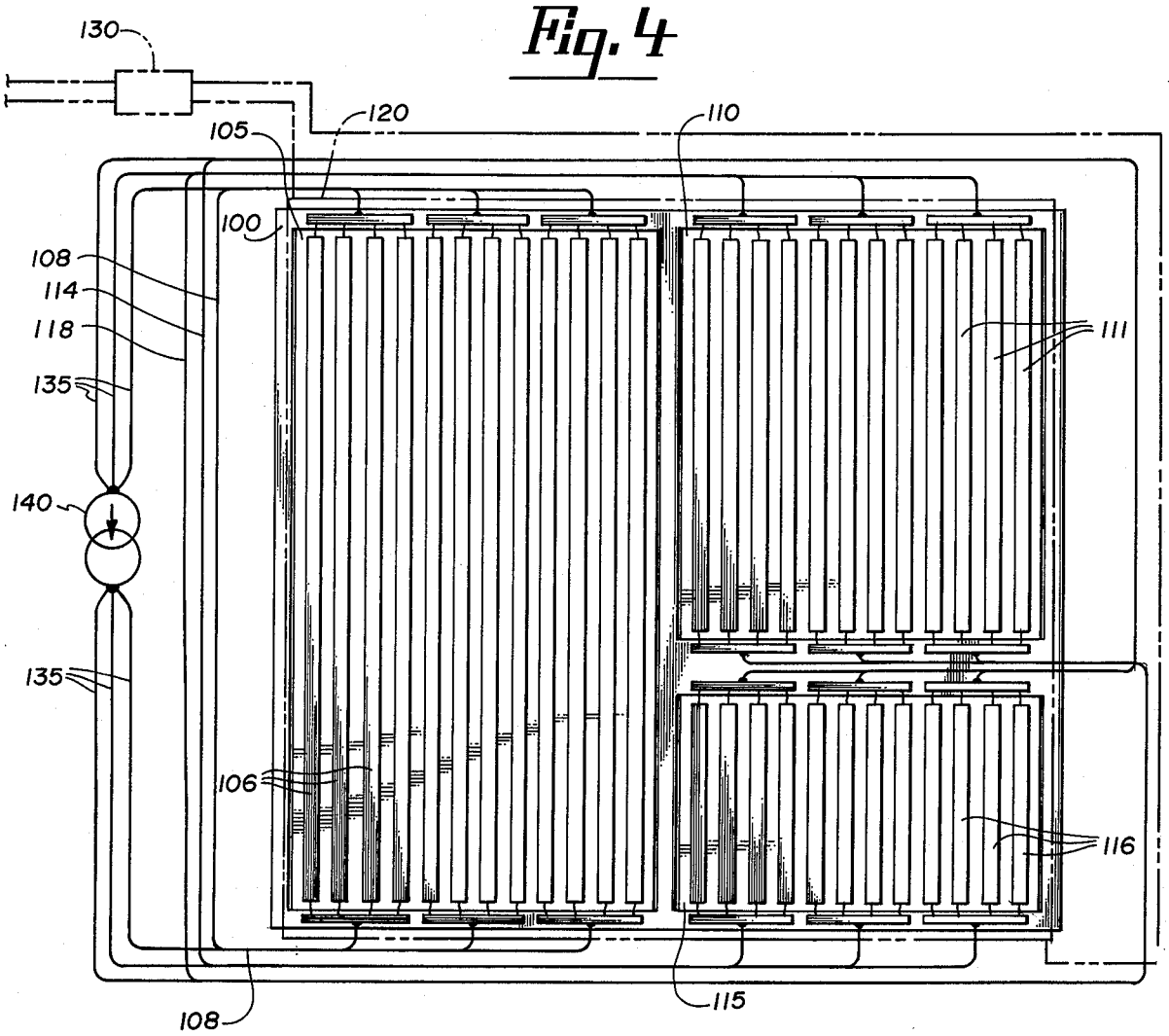
FIG. 4 is a schematic view of a planer type loud speaker disclosing the invention.

FIG. 4 shows schematically such a planar type of bipolar loud speaker or current sheet transducer having a plurality of vibratable diaphragms or elements thereon. In FIG. 4, a planar type frame 100 mounts separate vibratable diaphragms, 105, 110, and 115, each having a plurality of separate conductor strips 106, 111, and 116 respectively mounted thereon. These strips are preferably higher conductive material deposited in a spaced parallel relationship on the diaphragms and distributed over the vibratable areas of the diaphragms. Suitable external connections for the conductors 106, such as is indicated at 108 at either end of the diaphragm, are brought out and coupled externally to provide a series circuit for the conductors to provide the overall current flow on the diaphragm face in the same direction. The same arrangement of parts and circuit is used for the conductors 111 on the diaphragm 110 through external connections 114. Similarly, for the diaphragm 115, the conductors 116 thereon are connected through suitable external connections 118. A distributed coil 120 is wound around the entire frame with the windings aligned with the conductors 106, 111, and 116. The field element is adapted to be energized by a suitable unidirectional source, such as is indicated in block at 130, and the individual conductors on the diaphragms 105, 110 and 116 would be interconnected in either series or parallel circuits. As is indicated in FIG. 4, the parallel connected conductors 135 are connected to an energizing alternating audio frequency source 140. Such an arrangement of parts provides diaphragms of having different frequency response to cover a complete or wide range of audio frequencies with the conductors energized from the same power source and cooperating with the field generated by the same unidirectional power source. It should be recognized that any or all of the various vibratable areas can also be driven through an external crossover network, to give the desired frequency responses from the diaphragms.

Figure 6:
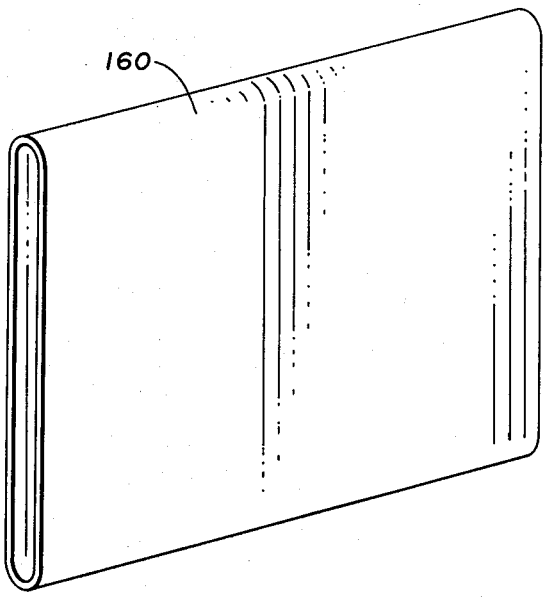
FIG. 6 is a schematic view in perspective of a field coil for the field generator of the improved electromagnetic transducer.
Figure 5:
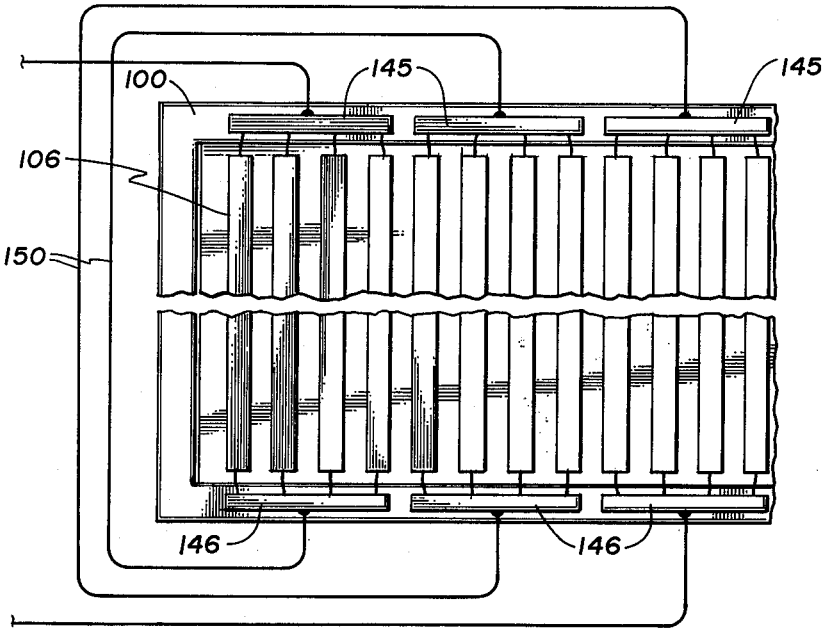
FIG. 5 is a schematic view of a portion of the diaphragm of FIG. 4.

FIG. 5 shows a portion of the diaphragm in the frame 100 in which the conductors 106 therein are connected through buses 145 and 146 to provide an arrangement of groups of the conductors on the diaphragm connected in the parallel relationship with two such groups of conductors being connected in a series relationship through external connections, such as is indicated at 150, to provide an overall conductor circuit having a different impedance than that provided by external serial connection of all conductors. FIG. 6 shows a wound coil at 160 which could be mounted on a suitable frame (not shown) to be slipped over the frame 100 mounting the vibratable diaphragms thereon with the external connections being brought out through the open ends of the same. Such open ends would out through the open ends of the same. Such open ends would not only provide for the connection of the external conductors away from the field so that current flow through the connections would not be affected by the field but will also provide for passage of air or air movement due to diaphragm movement.

The improved electromagnetic bipolar loud speaker or current sheet conductor of the present invention utilizes the principal of positioning the conductors on the vibratable area of the diaphragm so that current flow therethrough would be in the same direction with respect to the diaphragm. A plurality of such diaphragms would be mounted in the frame, the diaphragms being made of a very thin flexible dielectric material with the conductors deposited thereon to provide a low mass flexible and vibratable diaphragm. A number of such vibratable diaphragms with different frequency responses may be distributed in a frame with the same conductor orientation and with external connection which may provide either series or parallel circuits for the conductors therein. Thus the impedance of the circuits may be low or high impedance circuit to match the input supply. A single coil distributed over the entire frame mounting the diaphragms and either wound thereon or mounted on a separate frame such that the diaphragm frame may be positioned therein, will provide a homogeneous unidirectional magnetic field to interact with the conductors or the current flow in the conductors on the vibratable diaphragm areas. Such a coil eliminates the requirement of alignment of magnets with the conductors on the diaphragms and simplifies the power source for the energizing magnetic field. Various modifications of such a structure including variations in materials and circuit configuration may be made within the operating principle disclosed above.

Therefore, I wish to be limited only by the appended claims.

What I claim is:

1. An electromagnetic current sheet transducer comprising: a taut diaphragm of dielectrical material having a vibratable area positioned on a planar frame; a plurality of conductors positioned on the vibratable area of the diaphragm in spaced parallel relationship; an electrical bus positioned on the planar frame displaced from said diaphragm; a plurality of connector means for individually connecting the conductive strips to said bus; and a single magnetic field means generating a uniform magnetic field around the surface of the diaphragm and over the surface of the diaphragm normal to the direction of current flow through the conductors on the diaphragm.

2. An electromagnetic current sheet transducer of claim 1 in which the magnetic field generating means being a coil wound on said planar frame with an opening therein in which the diaphragm is positioned and through which portions of said connector means extend.

3. The electromagnetic current sheet transducer of claim 2 in which the conductors are strips of conductive material deposited on the diaphragm.

4. The electromagnetic current sheet transducer of claim 3 in which the connector means connecting the conductor strips are connected to the ends of each conductor strip to connect one strip to another through said bus to cause the current flow in the conductors in the same direction.

5. A sound generating transducer comprising a planar frame, a plurality of flexible diaphragms each having a vibratable area positioned in the planar frame, conductor means affixed on each of the diaphragms to receive audio frequency electric signals, connector means including electrical bus means positioned on said frame and connected to the conductor means on each of said diaphragms to cause current flow in the conductor means only in the same direction across the vibratable area of each diaphragm, and a single magnetic field generating means surrounding said frame and providing a uniform homogeneous magnetic field normal to the direction of current flow of the conductors in each of the diaphragms and uniformly over and around the vibratable areas of the diaphragm, said uniform homogenous magnetic field surrounding the diaphragm being generated by a coil wound around the diaphragm and circling the same with turns of the coil extending generally parallel to the conductor means positioned on the diaphragm.

6. The electromagnetic current sheet transducer of claim 5 in which the connector means connecting the conductor strips include bus means connecting certain of said conductor strips at the extremities with additional connecting means positioned outside the magnetic field connecting the buses in a series relationship.

7. The electromagnetic current sheet transducer of claim 5 in which the conductor means positioned on the diaphragm are strips of highly conductive material deposited on the diaphragm is spaced parallel relationship.

8. The electromagnetic current sheet transducer of claim 5 in which the conductors on the diaphragms are substantially uniformly spaced from the magnetic field means.

9. The electromagnetic current sheet transducer of claim 5 in which the conductors positioned on the diaphragm have the same cross sectional dimension and the same length dimension in the vibratable area.

10. The electromagnetic current sheet transducer of claim 5 in which the diaphragm is a thin layer of polyethelene-terphthalate material.

* * * * *